US010925363B1

(12) United States Patent
Schermerhorn

(10) Patent No.: US 10,925,363 B1
(45) Date of Patent: Feb. 23, 2021

(54) CANOPY TENSION SYSTEM

(71) Applicant: William R. Schermerhorn, Greensboro, NC (US)

(72) Inventor: William R. Schermerhorn, Greensboro, NC (US)

(73) Assignee: William R. Schermerhorn, Greensboro, NC (US)

( * ) Notice: Subject to any disclaimer, the term of this patent is extended or adjusted under 35 U.S.C. 154(b) by 0 days.

(21) Appl. No.: 16/565,563

(22) Filed: Sep. 10, 2019

Related U.S. Application Data

(60) Provisional application No. 62/729,761, filed on Sep. 11, 2018.

(51) Int. Cl.

| | |
|---|---|
| ***A45B 25/02*** | (2006.01) |
| ***E04H 15/28*** | (2006.01) |
| ***A45B 17/00*** | (2006.01) |
| ***A45B 25/14*** | (2006.01) |
| ***A45B 23/00*** | (2006.01) |

(52) U.S. Cl.
CPC ..... *A45B 25/02* (2013.01); *A45B 17/00* (2013.01); *A45B 23/00* (2013.01); *A45B 25/14* (2013.01); *E04H 15/28* (2013.01); *A45B 2023/0012* (2013.01); *A45B 2025/146* (2013.01)

(58) Field of Classification Search
CPC ..... A45B 25/02; A45B 23/00; A45B 25/18; A45B 25/14; A45B 25/08; A45B 2025/146; A45B 17/00; E04H 15/28; E04H 15/26
USPC ..... 135/98–99, 155, 31–32, 33.5, 20.1
See application file for complete search history.

(56) References Cited

U.S. PATENT DOCUMENTS

| | | | | | |
|---|---|---|---|---|---|
| 728,035 | A * | 5/1903 | Sprague | A45B 25/18 | 135/33.5 |
| 918,830 | A * | 4/1909 | Eberle | A45B 25/18 | 135/33.5 |
| 3,794,279 | A * | 2/1974 | Kramer | E04H 12/2246 | 248/523 |
| 3,873,821 | A * | 3/1975 | Larson | F21V 7/18 | 362/3 |
| 4,633,894 | A * | 1/1987 | Okuda | A45B 25/18 | 135/33.5 |
| 5,452,877 | A * | 9/1995 | Riffle | E04H 12/2246 | 248/511 |
| 5,694,958 | A * | 12/1997 | Chang | A45B 25/18 | 135/31 |
| 8,047,217 | B1 * | 11/2011 | Schermerhorn, Jr. | E04H 12/2246 | 135/118 |

(Continued)

FOREIGN PATENT DOCUMENTS

| | | | | |
|---|---|---|---|---|
| EP | 531240 | A1 * | 3/1993 | A45B 25/16 |
| FR | 2426425 | A1 * | 12/1979 | A45B 25/18 |

*Primary Examiner* — Noah Chandler Hawk
(74) *Attorney, Agent, or Firm* — MacCord Mason PLLC

(57) ABSTRACT

A canopy tension system for an umbrella. The umbrella comprises a frame having a pole with a rib assembly at one end, the rib assembly comprising a plurality of ribs an end cap assembly attached to a distal end of each rib, the end cap assembly including a channel with an adjustable depth for receiving the rib; and a canopy attached to the end cap assembly of each rib of the frame. The end cap assemblies are adapted to modify the tension of the canopy to prevent excessive or insufficient tension when the canopy is mounted by adjusting the depth of one or more channels before the distal end of the rib is inserted.

9 Claims, 8 Drawing Sheets

(56) References Cited

U.S. PATENT DOCUMENTS

| | | | | |
|---|---|---|---|---|
| 8,640,720 | B1 * | 2/2014 | Roberto | A45B 25/18<br>135/26 |
| 9,775,416 | B2 * | 10/2017 | Harris | A45B 11/00 |
| 9,943,148 | B1 * | 4/2018 | You | A45B 25/00 |
| 2004/0107979 | A1 * | 6/2004 | Lai | A45B 17/00<br>135/20.3 |
| 2017/0238661 | A1 * | 8/2017 | Haythornthwaite | A45B 25/22 |

* cited by examiner

CANOPY TENSION SYSTEM

This application claims the benefit of provisional application No. 62/729,761, filed Sep. 11, 2018, which is incorporated herein by reference in its entirety.

FIELD OF THE TECHNOLOGY

The present inventions relate generally to umbrellas and, more particularly, to a system for adjusting the tension of a canopy on an umbrella.

BACKGROUND

If the canopy tension on an umbrella is too tight several issues may occur, for instance the umbrella may be very difficult to open or the excessive stress on the fabric and frame components may cause the umbrella to fail. On the other hand, if the canopy tension is too light, then another set of issues can occur. The umbrella will not form its shape and the canopy will flap in the wind causing the canopy to disengage from the canopy or even invert.

Costs remain a major issue for providing an umbrella having proper canopy tension. Despite the importance of proper canopy tension, only a third of the canopies manufactured will have a tension within quality specifications. Stringent quality control measures implemented during manufacturing significantly increases manufacturing cost. Also, quality control cost increase and the risk that defective products being sold increase can negatively affect the brand with the customers.

One remedy is to modify the frames for those canopies that are too tight by cutting down the length of the frame ribs, but this solution also increases the cost of manufacturing. Moreover, there is no remedy for those frames that are too short because the frame ribs cannot be lengthened once they have been produced, and therefore, these frames must be discarded.

Thus, Applicant desires a canopy tension system to provide an adjustable frame rib for proper tension, without the drawbacks presented by the traditional systems and methods.

SUMMARY

In accordance with the present disclosure, a canopy tension system is provided for achieving and maintaining the proper canopy tension so that an umbrella will perform as intended.

In one embodiment, an umbrella includes a frame having a pole with a rib assembly at one end, the rib assembly comprising a plurality of ribs; an end cap assembly attached to a distal end of each rib, the end cap assembly including a channel with an adjustable depth for receiving the rib; and a canopy attached to the end cap assembly of each rib of the frame. The end cap assemblies are adapted to modify the tension of the canopy to prevent excessive or insufficient tension when the canopy is mounted by adjusting the depth of one or more channels before the distal end of the rib is inserted. The end cap assembly may be tubular.

In certain examples, the umbrella may include a base installed on the bottom of the pole adapted for retaining the umbrella in an upright position. For example, the base may be comprised of a rigid container receiving a fluid. In another example, the base may be a tarp including a reinforcement disposed centrally within the tarp, an opening disposed within the reinforcement, a plurality of spaced apart grommets disposed outwardly within the tarp, whereby each grommet is adapted to be attached to the pole.

One embodiment of the umbrella includes a hub for the rib assembly to attach to the pole. A pulley assembly may be included to open and close the canopy and further include a pin to be inserted into a hole in the pole to retain the canopy in an open configuration. In another example, a crank assembly may be included to open and close the canopy. The umbrella may also include a tilt mechanism attached onto the pole to tilt the rib assembly and canopy at an angle with respect to the pole.

In particular examples, a finial may be added to the top of the canopy. The canopy may further include a vent for air to pass through the canopy.

In another embodiment, an end cap assembly installed onto a distal end of a rib for an umbrella frame to modify the tension of a canopy attached to the umbrella frame includes a tube having an open end with a channel adapted to receive a rib of an umbrella frame and a closed end adapted to be received by a canopy; and one or more inserts adapted to fit within the channel of the tube to modify the tension of the canopy by extending an effective length of the rib of the umbrella frame. The tension of the canopy can be increased by adding inserts into the tube to increase the effective length of the rib that the end cap assembly is attached to and the tension of the canopy can be decreased by removing inserts from the tube to decrease the effective length of the rib that the end cap assembly is attached to.

In one embodiment, the closed end of the tube is substantially T-shaped.

The insert may be comprised of rubber. Between about one and about four inserts may be inserted into the tube.

In some examples, the length of the tube may range between about 1 inch to about 5 inches. For instance, the length of the tube may be about 2.5 inches. In some examples, the depth of the insert is between about 5 millimeters and about 20 millimeters. For instance, the depth of the insert may be about 10 millimeters.

In another embodiment, an umbrella comprising a frame having a pole with a rib assembly at one end, the rib assembly comprising a plurality of ribs; an end cap assembly attached to a distal end of each rib to modify the tension of a canopy attached to the umbrella frame; and a canopy attached to the end cap assembly of each rib of the frame. The end cap assembly comprises a tube having an open end with a channel adapted to receive a rib of an umbrella frame and a closed end adapted to be received by a canopy; and one or more inserts adapted to fit within the channel of the tube to modify the tension of the canopy by extending an effective length of the rib of the umbrella frame. The tension of the canopy can be increased by adding inserts into the tube to increase the effective length of the rib that the end cap assembly is attached to and the tension of the canopy can be decreased by removing inserts from the tube to decrease the effective length of the rib that the end cap assembly is attached to.

The present inventions may also be considered a method for adjusting the canopy tension of an umbrella. In one example, each rib is fitted with a "T" shape tubular end cap. The cap may be loosely fitted so that it can be easily removed without the use of any tools. A small insert may then be added to each cap before it is attached to the rib. By doing so, the rib has been effectively lengthened by the size of the insert. After all end caps have been attached to the ribs, the canopy is attached and the umbrella opened and checked for tension. If the tension is too loose, then additional inserts may be added effectively lengthening each rib.

Conversely, if the canopy is too tight then inserts can be removed effectively reducing the length of the rib.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF THE PREFERRED EMBODIMENTS

Figure 1:
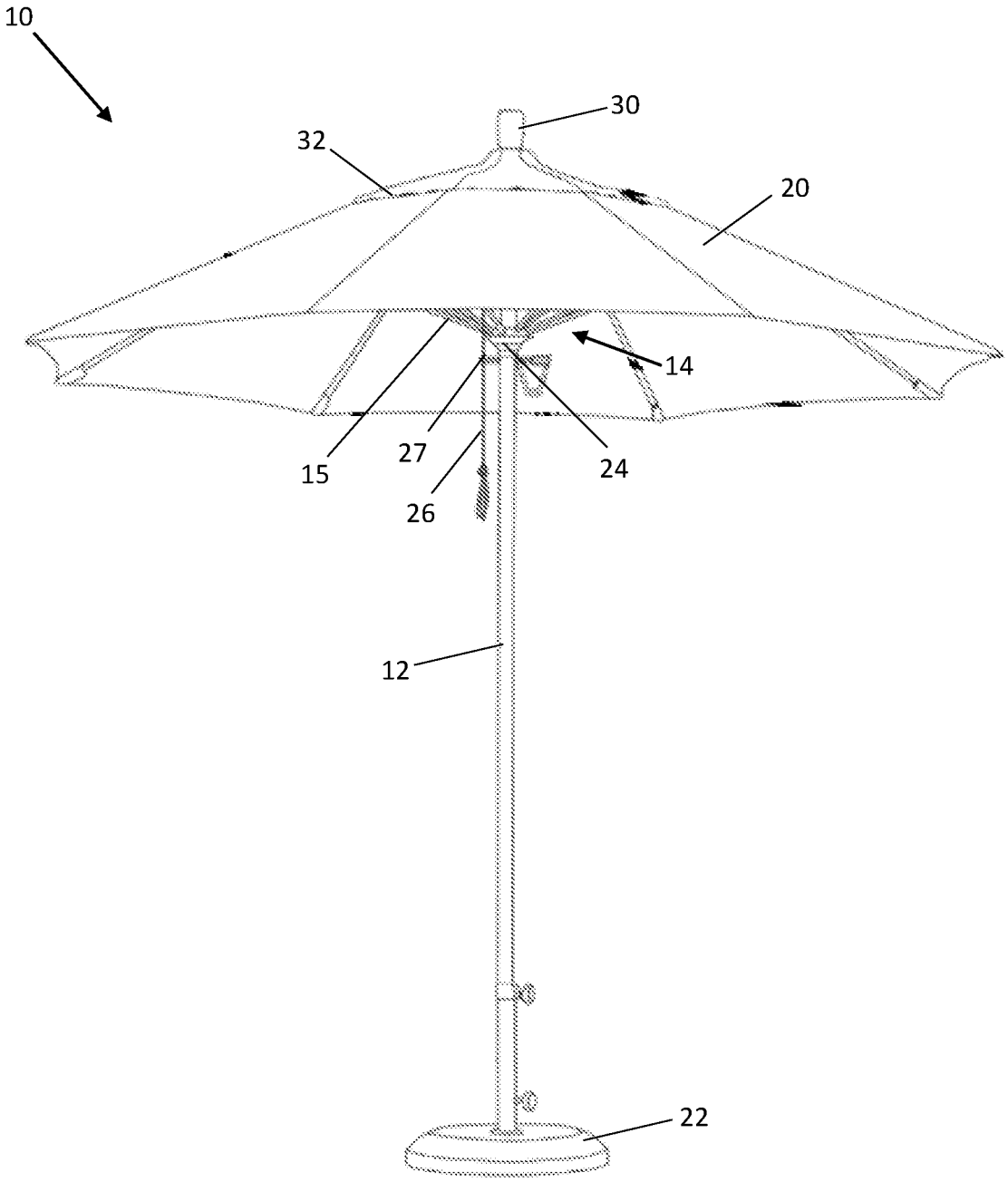
FIG. 1 is a front perspective view of an umbrella according to one embodiment of the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing an embodiment of the invention and are not intended to limit the inventions thereto. As seen in FIG. 1, an umbrella with a canopy tension system, generally designated 10, is shown constructed according to the present inventions. The umbrella 10 is comprised of a pole 12 having a rib assembly 14 to support a canopy 20. One or more ribs 15 includes an end cap assembly at its distal end, wherein each end cap assembly is inserted into the canopy 20 to mount it onto the rib assembly 14.

The pole 12 may be supported by a base 22. As seen in FIG. 1, the base 22 may comprise a rigid container with sand, water or another fluid inside. The rib assembly 14 may be attached to the pole 12 via a hub 24. When the hub 24 is raised along the pole 12, the canopy 20 is opened. As the hub 24 is lowered along the pole 12, the canopy 20 is closed. A pulley assembly 26 may be included to raise and lower the hub 24. The hub 24 may be held in its position using a pin 27.

A finial 30 may be included on top of the canopy 20. The canopy 20 may also include a vent 32 for air to pass through the canopy in order to enable heat to escape from underneath the umbrella 10 and allow cool air to enter under the umbrella.

Figure 2:
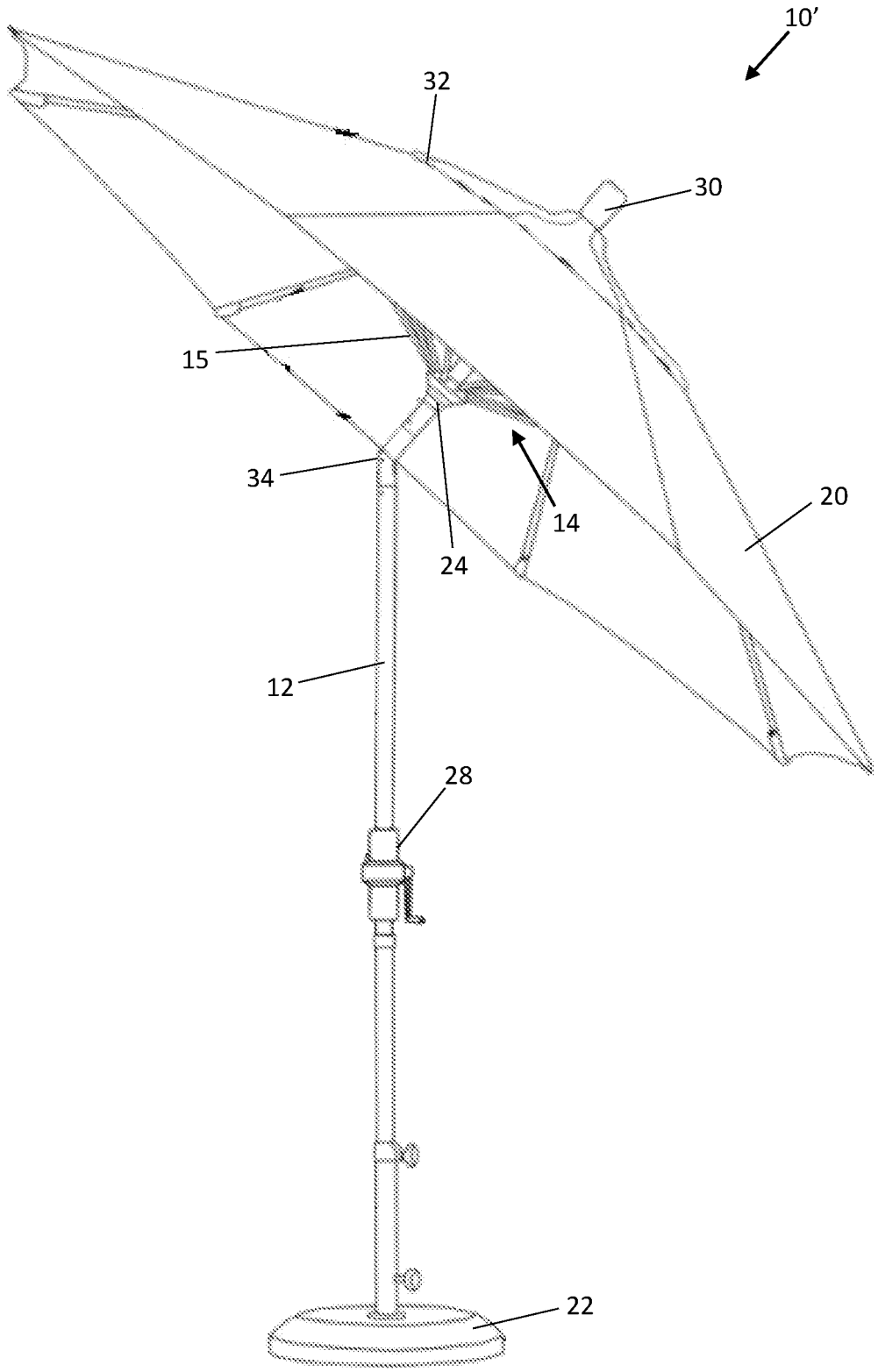
FIG. 2 is a front perspective view of an umbrella according to another embodiment of the present invention.

Another example of an umbrella 10' having a canopy tension system is shown in FIG. 2. The umbrella includes a crank assembly 28 adapted to open and close the canopy, and further includes a tilt mechanism 34 for angling the canopy in a desired direction.

Figure 3:
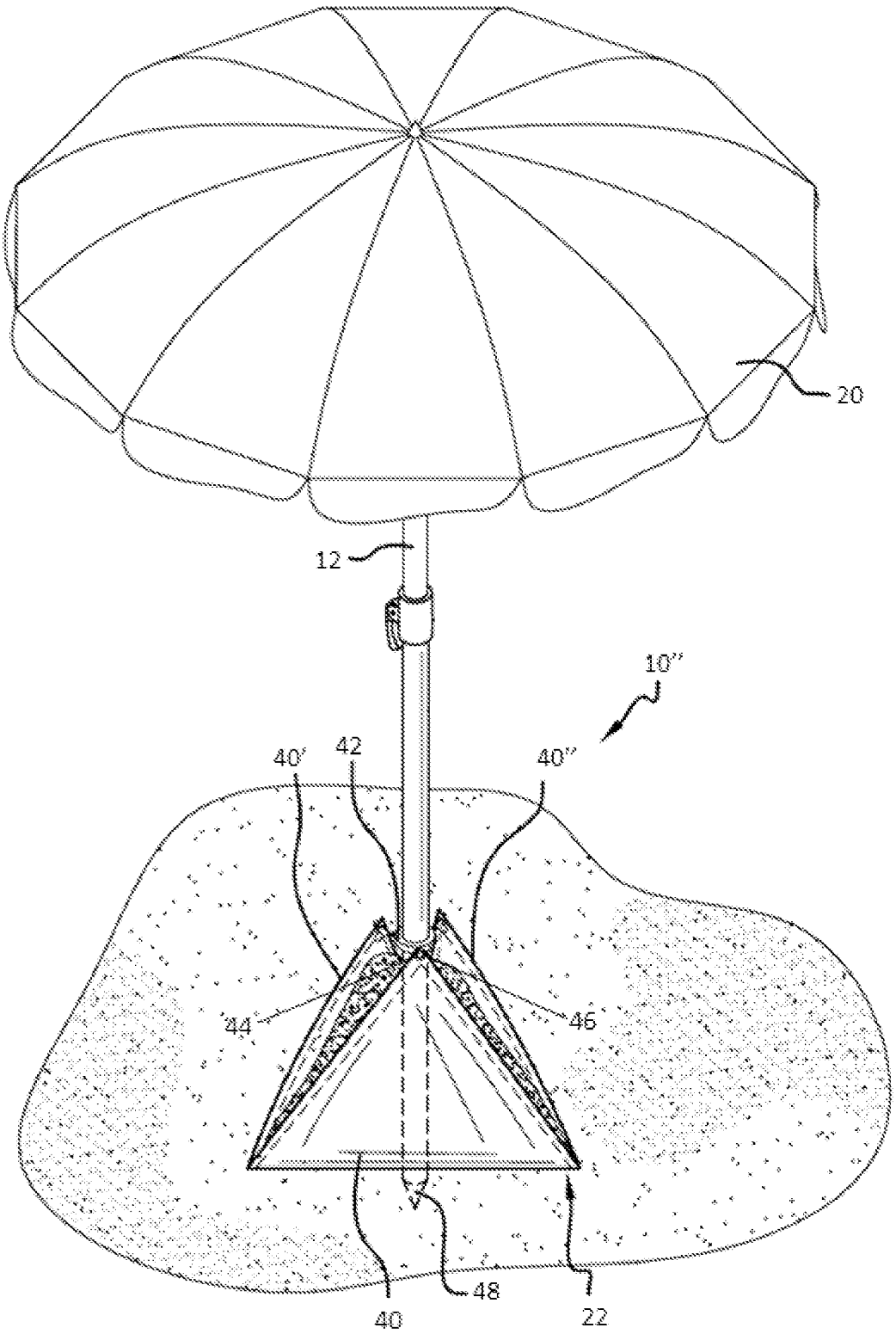
FIG. 3 is a top perspective view of an umbrella according to another embodiment of the present invention.

FIG. 3 illustrates another example of an umbrella 10" with a canopy tension system. The umbrella 10" is supported by a base 22. In this example, the base 22 is comprised of a tarp 40 adapted to attach to a collar 42 installed onto the pole 12. In one embodiment, the tarp 40 is comprised of three outer triangles 40, 40', 40" that attach to the collar 42. Each outer triangle 40 may be attached to the collar 42 via a grommet 44 that engages with a fastener 46 on the collar 42. Other similar mechanisms may also be used to attach the tarp 40 to the pole 12, including fasteners installed directly onto each outer triangle 40 that are inserted into holes on the pole 12 or collar 42. The tarp 40 also includes a reinforcement with an opening for the end 48 of pole 12 to insert through and into the ground. Sand may be used to fill the base 12.

Figure 4:
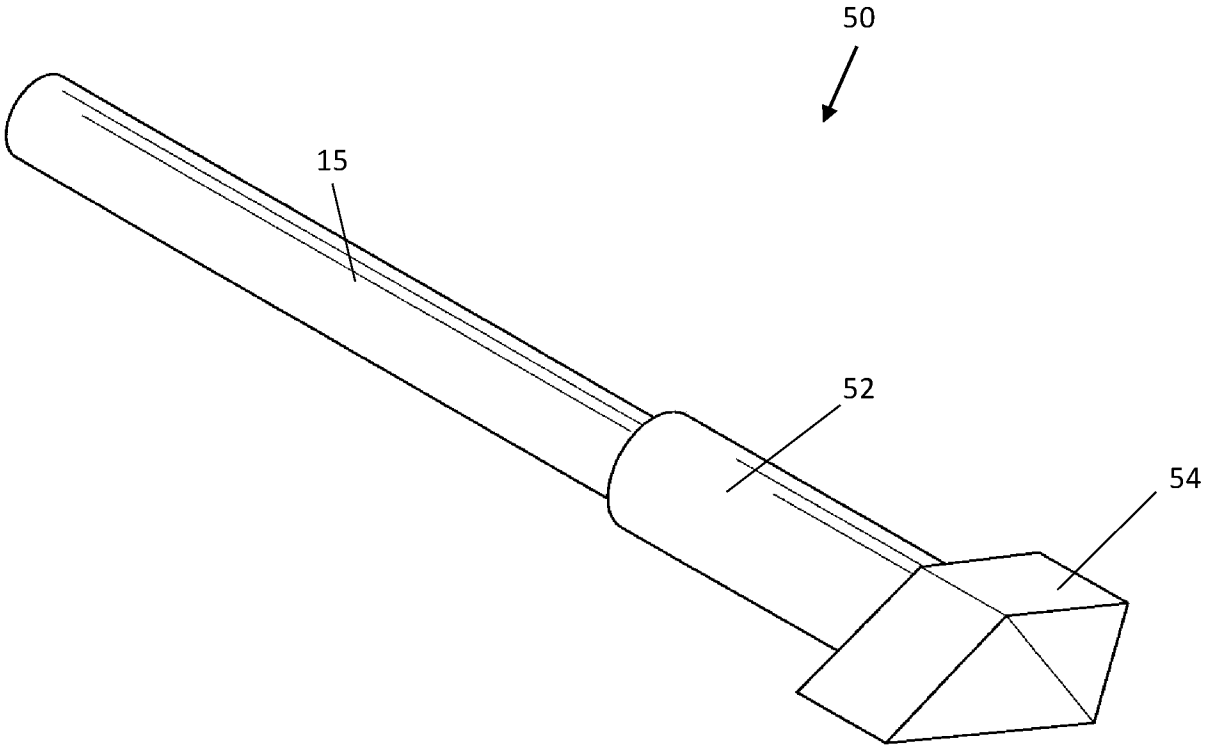
FIG. 4 is a top perspective view of an end cap assembly according to one embodiment of the present invention.
Figure 5:
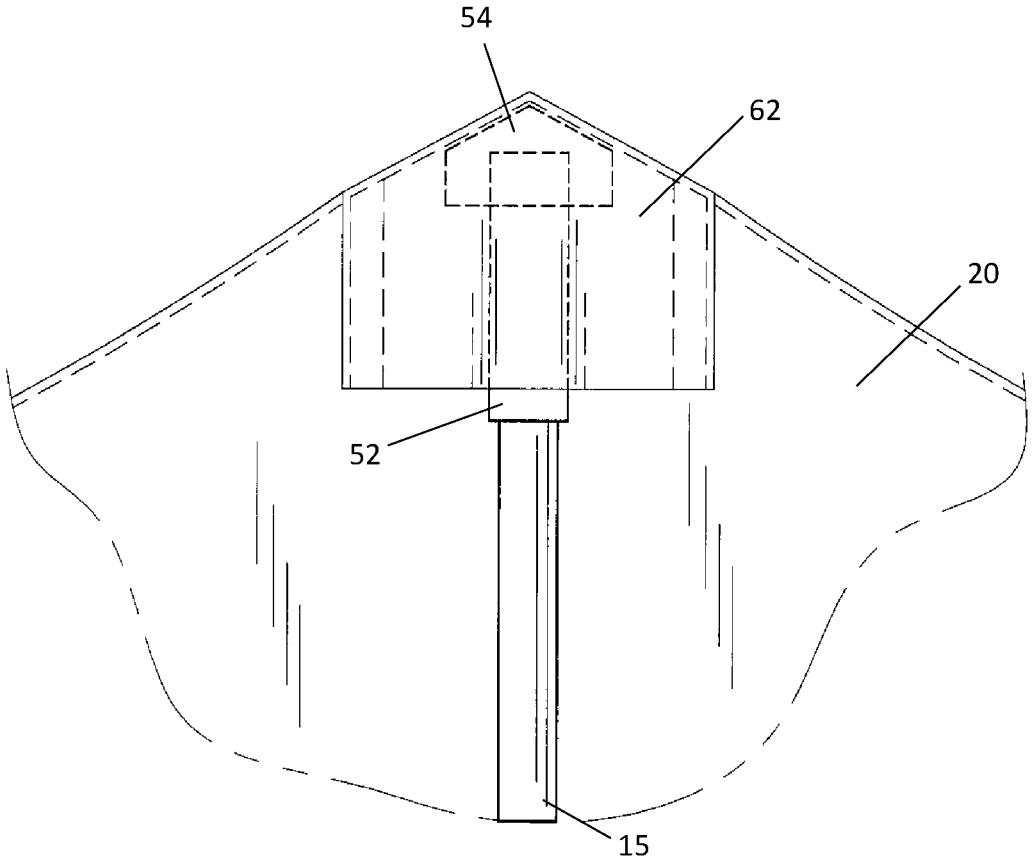
FIG. 5 is an enlarged cross-sectional view of an end cap assembly installed over a rib inserted into a canopy.
Figure 6:
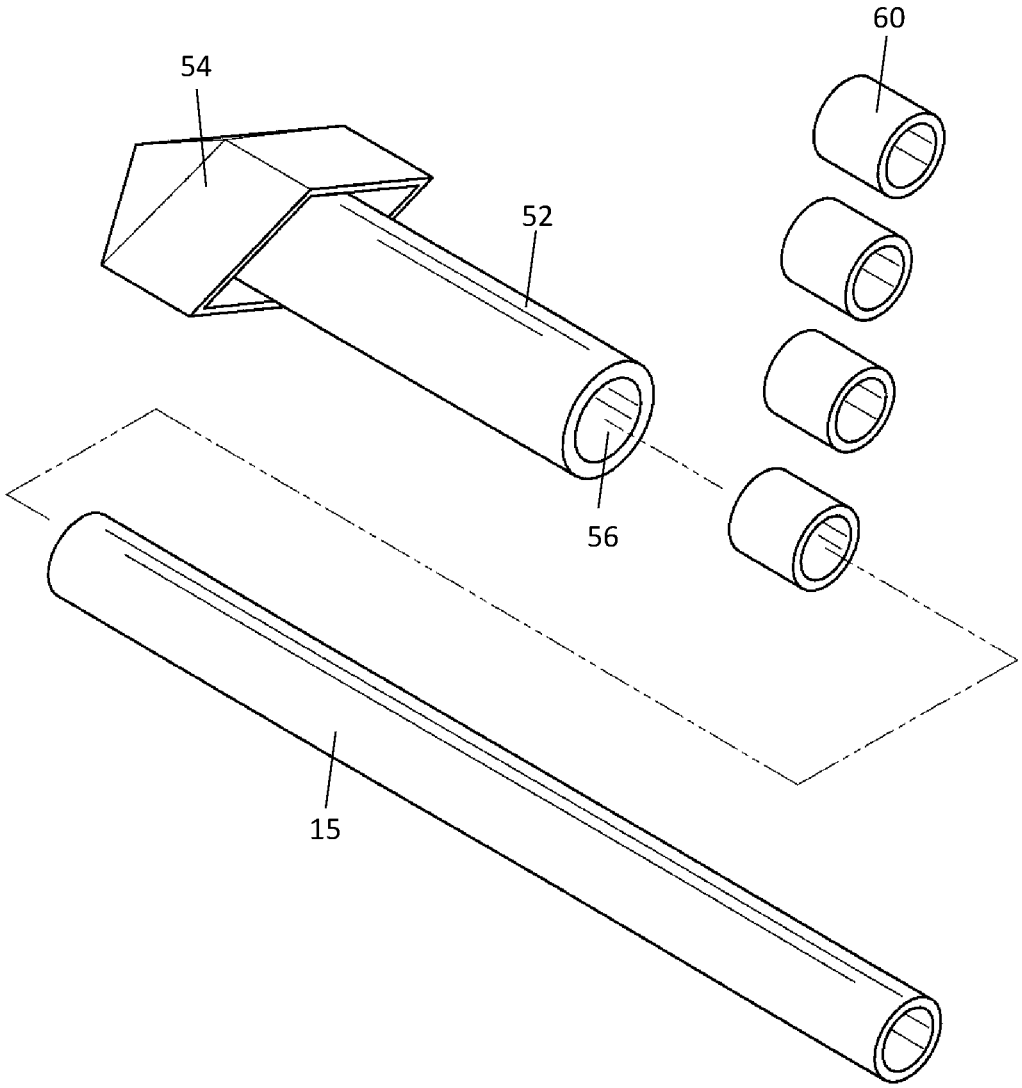
FIG. 6 is a disassembled view of the end cap assembly shown in FIG. 4.

One example of an end cap assembly 50 to be used as a canopy tension system is shown in FIGS. 4-6. The end cap assembly 50 is comprised of a tube 52 adapted to receive a distal end of rib 15 (wherein the proximal end of rib 15 is attached to the hub 24). The tube 52 may further include a T-shaped end 54 adapted to disperse pressure on the canopy when inserted into pocket 62 of the canopy 20 to prevent the tube 52 from slipping out.

Figure 7:
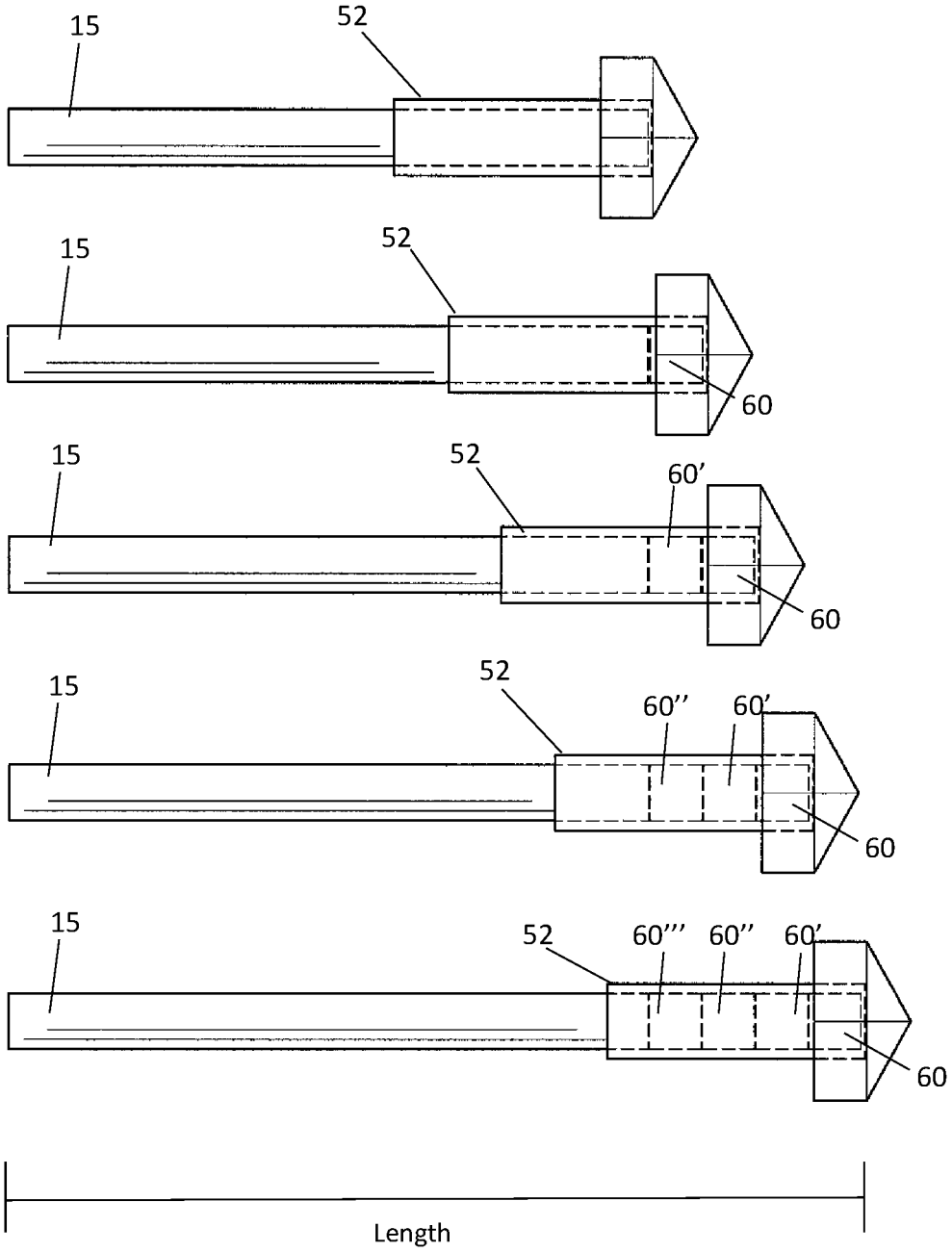
FIG. 7 is a partially cross-sectional view of the end cap assembly shown in FIG. 4.

FIG. 6 provides a partially disassembled view of the end cap assembly 50 wherein a plurality of inserts 60 may be inserted into a channel 56 prior to insertion of the rib 15 into the channel 56. FIG. 7 illustrates the effect of adding one or more inserts 60 into the tube 52. As each insert 60 is added to the tube 52, the depth of the channel 56 decreases for the rib 15 to enter into. By decreasing the depth for the rib 15 to enter, the effective length of the rib 15 increases when inserted into the pocket 62 of the canopy 20.

Preferably, the length of the tube 52 is within a range wherein inserting the rib 15 into the end cap assembly 50 still results in an overall length wherein the canopy 20 can be mounted onto the rib assembly 14. For example, the tube may have a length within a range of about 1 inch to about 5 inches. In one embodiment, the tube 52 may have a length of about 2.5 inches.

Figure 8:
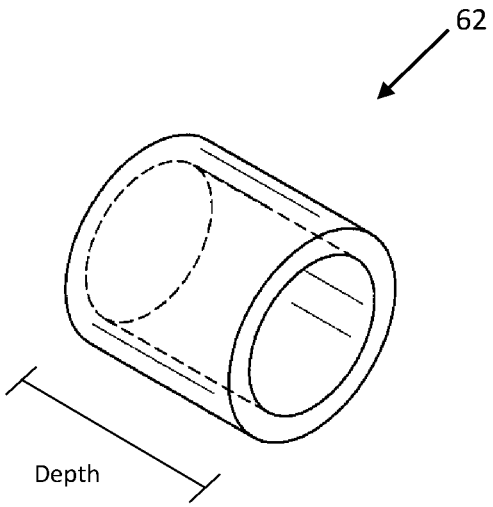
FIG. 8 is a side perspective view of an insert according to one embodiment of the present invention.

One example of an insert 60 adapted to be inserted into the tube 52 is shown in FIG. 8. The depth of each insert 60 is preferably within a range that is large enough to provide a discernible effect on the tension of a canopy 20 with each insert added/removed, while at the same time, is small enough so that the tension of the canopy 20 can be adequately fine-tuned (i.e., adding or removing an insert 60 does not cause such an increase/decrease in canopy tension that the tension cannot be properly calibrated). For example, the depth of the insert may range between about 5 millimeters and about 20 millimeters. In one embodiment, the depth of the insert is about 10 millimeters, wherein each insert 60 provides about an additional 0.25 lb of tension to the canopy.

In operation, the end cap assembly may be used to adjust the tension of a canopy by modifying the effective length of the ribs to be inserted into the canopy. The initial tension may be determined by the size of the frame and the size of the canopy. During manufacturing of the umbrella itself, there are 9 possible outcomes that determine the tension of the canopy. The frame and canopy can be too small, just right or too large. When the canopy is attached to the frame, the statistical probability that the tension will be within an acceptable range is as follows:

1) Loose Canopy: F1+C2 or F2+C3

2) Tight Canopy: F2+C1 or F3+C2

3) Extremely Loose: F1+C3

4) Extremely Tight: F3+C1

5) Within acceptable range: F1+C1 or F2+C2 or F3+C3 wherein F1=Frame too small; F2=Frame acceptable; F3=Frame too large; C1=Canopy too small; C2=Canopy acceptable; C3=Canopy too large.

The end cap assembly provides a solution for examples 1-4, wherein the frame and canopy have dimensions that are not within an initially acceptable range. For umbrellas that have a frame and canopy combination resulting in a loose canopy, the end cap assembly can be added to one or more ribs along with one or more inserts to increase the size of the frame to increase the tension within an acceptable range. For umbrellas that have a frame and canopy combination resulting in a tight canopy, the ribs may be initially shortened to reduce canopy tension, and an end cap assembly may be added to fine-tune the effective length of the rib to create the desired canopy tension. Moreover, as the canopy loosens over time, additional inserts may be added to the end cap assembly to maintain proper canopy tension. If the canopy tension becomes too tight, one or more inserts may be removed from the tube.

Certain modifications and improvements will occur to those skilled in the art upon a reading of the foregoing description. The end cap assembly may be used in a variety of umbrellas to adjust the tension of a canopy, and is not limited by the embodiments disclosed herein. Moreover, the depth of the channel may be adjusted by other means. For example, the end cap assembly may comprise a series of tubes with different lengths and/or channel depths wherein the tension of the canopy may be adjusted by inserting a tube having the desired length and/or channel depth. It should be understood that all such modifications and improvements have been deleted herein for the sake of conciseness and readability but are properly within the scope of the following claims.

I claim:

1. An end cap assembly adapted to be installed onto a distal end of a rib for an umbrella frame, said assembly comprising:

(a) a tube having an open end with a channel adapted to receive a rib of an umbrella frame and an opposing closed end adapted to be received by a canopy; and (b) one or more spacer inserts adapted to fit within said channel of said tube to modify said tension of said canopy by extending an effective length of said rib of said umbrella frame, wherein said spacer inserts spatially calibrate an acceptable tension of said canopy, and whereby a tension of said canopy adapted to be increased by adding spacer inserts into said tube to increase said effective length of said rib.

2. The assembly of claim 1, wherein said closed end of said tube is substantially T-shaped.

3. The assembly of claim 1, wherein between one and four spacers inserts are inserted into said tube.

4. The assembly of claim 1, wherein said tension of said canopy can be decreased by removing spacer inserts from said tube to decrease said effective length of said end cap assembly rib.

5. An umbrella comprising:

(a) a frame having a pole with a rib assembly at one first end, said rib assembly comprising a plurality of ribs;

(b) an end cap assembly attached to a distal end of each rib to modify said tension of a canopy attached to said umbrella frame comprising (i) a tube having an open end with a channel adapted to receive a rib of an umbrella frame and a closed end adapted to be received by said canopy; and (ii) one or more spacer inserts adapted to fit within said channel of said tube to calibrate an acceptable tension of said canopy by extending an effective length of said rib of said umbrella frame independent of a canopy condition, (c) a canopy attached to said end cap assembly of each rib of said frame, and whereby said tension of said canopy is adapted to be increased by adding spacer inserts into said tube to increase said effective length of said rib that said end cap assembly is attached to and said tension of said canopy adapted to be decreased by removing spacer inserts from said tube to decrease said effective length of said rib that said end cap assembly is attached to.

6. The umbrella of claim 5, including a base installed on said bottom of said pole adapted for receiving a fluid and retaining said umbrella in an upright position.

7. The umbrella of claim 5, wherein said base is a tarp including a reinforcement disposed centrally within said tam, an opening disposed within said reinforcement, a plurality of spaced apart grommets disposed outwardly within said tarp, whereby each grommet is adapted to be attached to said pole.

8. The umbrella of claim 5, including a hub for said rib assembly to attach to said pole.

9. The umbrella of claim 5, wherein said closed end of said tube is substantially T-shaped.

* * * * *